US008286565B2

(12) United States Patent
Valiulis et al.

(10) Patent No.: US 8,286,565 B2
(45) Date of Patent: Oct. 16, 2012

(54) SECURITY LOCK BOX

(75) Inventors: Thomas E. Valiulis, Rockford, IL (US); Robert Louis Northrup, Jr., Machesney Park, IL (US); Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 373 days.

(21) Appl. No.: 12/619,762

(22) Filed: Nov. 17, 2009

(65) Prior Publication Data

US 2011/0113992 A1 May 19, 2011

(51) Int. Cl.
*E05G 1/04* (2006.01)

(52) U.S. Cl. ..... 109/51; 109/52; 206/1.5; 312/102; 312/138.1

(58) Field of Classification Search ..... 109/49.5–52; 312/101, 102, 137, 138.1, 215, 219, 222; 206/1.5, 527, 776
See application file for complete search history.

(56) References Cited

U.S. PATENT DOCUMENTS

| | | | | |
|---|---|---|---|---|
| 1,861,935 | A * | 6/1932 | O'Donnell | 248/553 |
| 1,983,716 | A * | 12/1934 | Vidal | 109/52 |
| 2,631,912 | A * | 3/1953 | Pryor, Sr. | 312/139.1 |
| 3,146,739 | A * | 9/1964 | Furman | 109/52 |
| 3,645,594 | A * | 2/1972 | Cintz | 312/100 |
| 4,070,074 | A * | 1/1978 | Rohme | 312/245 |
| 4,182,062 | A * | 1/1980 | Krokos et al. | 40/209 |
| 4,252,219 | A * | 2/1981 | Kauffman | 188/69 |
| 4,258,632 | A * | 3/1981 | LaPointe | 109/59 R |
| 4,457,240 | A * | 7/1984 | Hungerford | 109/45 |
| 4,475,311 | A * | 10/1984 | Gibson | 49/176 |
| 4,521,985 | A * | 6/1985 | Smith et al. | 42/7 |
| 4,577,563 | A * | 3/1986 | Sidler | 109/52 |
| 4,645,876 | A * | 2/1987 | Albertson | 379/143 |
| 4,856,436 | A * | 8/1989 | Campbell | 109/1 R |
| 5,235,920 | A * | 8/1993 | Hector | 109/51 |
| 5,257,584 | A * | 11/1993 | Pastor | 109/51 |
| 6,085,671 | A * | 7/2000 | Kerr et al. | 109/51 |
| 7,228,963 | B1 * | 6/2007 | Feibelman et al. | 206/301 |
| 7,299,667 | B1 * | 11/2007 | Miresmaili | 70/58 |
| 7,744,170 | B1 * | 6/2010 | Rutler | 312/102 |
| 7,780,000 | B2 * | 8/2010 | Mazzucchelli | 206/308.2 |
| 7,850,192 | B2 * | 12/2010 | Ceccarelli et al. | 280/478.1 |
| 2009/0001117 | A1 * | 1/2009 | Rassias | 224/673 |
| 2009/0166228 | A1 * | 7/2009 | Kinunen | 206/1.5 |

* cited by examiner

*Primary Examiner* — Suzanne Barrett
(74) *Attorney, Agent, or Firm* — Reinhart Boerner Van Deuren P.C.

(57) ABSTRACT

A security lock box that is mountable to a shelf. The shelf has a shelf surface for supporting merchandise thereon. The security lock box includes a cover adapted to be supported on top of the shelf and adapted to house and secure merchandise supported on the shelf therein. The cover is at least partially transparent to display merchandise when housed therein. The security lock box further includes a security device, which has a shelf mount and a lock. The shelf mount is adapted to be fastened to the shelf, and the lock releasably locks the cover to the shelf mount between a locked state, wherein the cover is locked to the shelf mount, and an unlocked state, wherein the cover is releasable from the shelf mount.

7 Claims, 6 Drawing Sheets

SECURITY LOCK BOX

FIELD OF THE INVENTION

The present invention generally relates to retail display apparatus for displaying retail merchandise, typically in a retail store environment and more particularly relates to bins, trays or other such forms of receptacles that can be mounted to various types of retail support structures such as shelves or racks.

BACKGROUND OF THE INVENTION

Retail, or inventory, shrinkage is defined as inventory losses occurring from employee theft, shoplifting, organized retail crime, administrative error and vendor fraud. Of these, it is estimated that employee theft and shoplifting account for approximately 80% of the dollars lost to shrinkage. Retail shrinkage is the single largest category of larceny in the United States, larger than motor vehicle theft, bank robbery, and household burglary combined. According to the National Retail Federation, in 2006 the retail industry lost more than $41 billion to shrinkage, of which nearly $33 billion could be attributed to employee theft and shoplifting.

Consumers, as well as retailers, are affected by this type of theft. Losses realized by the retailers are passed on to consumers in the form of higher prices and reduced availability of popular retail merchandise. In 2002, the average American family spent approximately $440 more in higher prices because of inventory theft.

It would therefore be desirable to have device which allows for the display of retail merchandise, but which deters theft by employees and consumers. Embodiments of the invention provide such a device. These and other advantages of the invention, as well as additional inventive features, will be apparent from the description of the invention provided herein.

BRIEF SUMMARY OF THE INVENTION

In one aspect, embodiments of the invention provide a security lock box for protecting merchandise against theft that has a locking bar with an opening therethrough. The locking bar is configured to be removably attached to a flat surface, such as a shelf for supporting sale items, as would typically be found in retail establishments. The security lock box also includes a transparent top cover having a locking mechanism, such that the top cover is configured to securely enclose merchandise, such as those sold in a retail setting, which have been placed on the flat surface or shelf. Further, the locking mechanism is configured to be inserted into the locking bar opening such that the top cover is securely attached to the flat surface so as to prevent access to the merchandise enclosed by the top cover.

In another aspect, embodiments of the invention provide a security lock box that is mountable to a shelf. The shelf has a shelf surface for supporting merchandise thereon. The security lock box includes a cover adapted to be supported on top of the shelf and adapted to house and secure merchandise supported on the shelf therein. The cover is at least partially transparent to display merchandise when housed therein. The security lock box further includes a security device, which has a shelf mount and a lock. The shelf mount is adapted to be fastened to the shelf, and the lock releasably locks the cover to the shelf mount between a locked state, wherein the cover is locked to the shelf mount, and an unlocked state, wherein the cover is releasable from the shelf mount.

In yet another aspect, embodiments of the invention provide an apparatus for displaying and securing merchandise, including, in combination, a merchandise shelf adapted to support said merchandise thereon, and a cover supported on top of the shelf. The cover is adapted to house and secure merchandise supported on the shelf therein. Further, the cover is at least partially transparent to display merchandise when housed therein. The apparatus also includes a security device for securing the cover to the shelf when the security device is in a locked state. The security device is also adapted to release the cover to allow access to merchandise when the security device is in an unlocked state Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
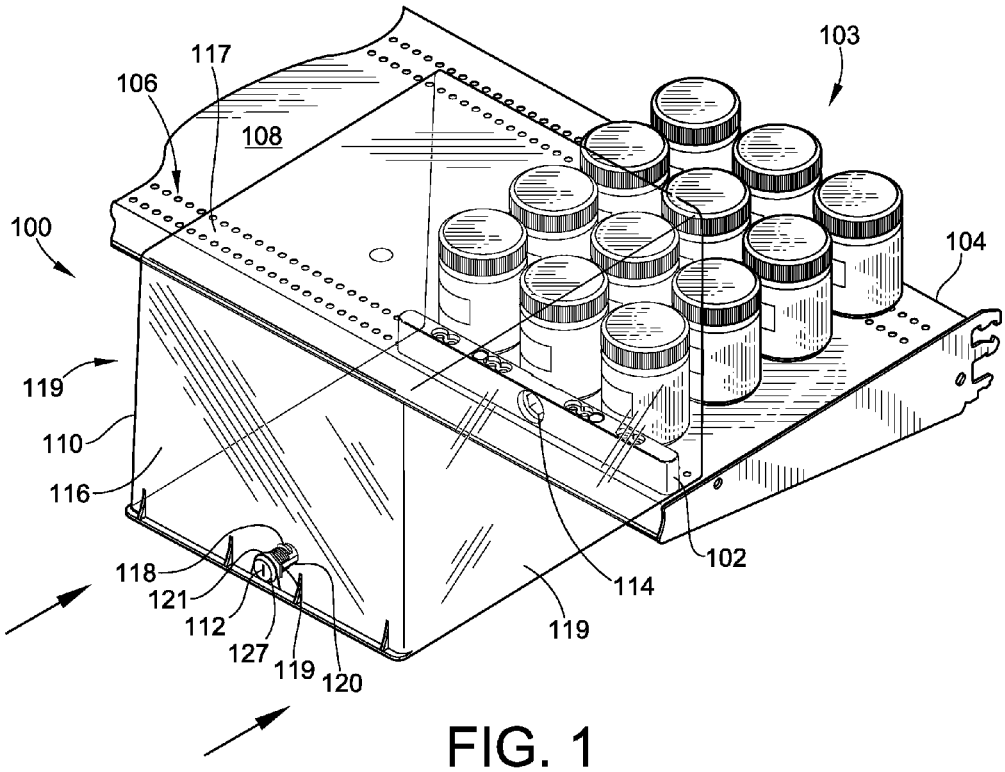
FIG. 1 is a perspective view of the security lock box before top cover has been secured to a locking bar, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

FIGS. 1-5 illustrate an exemplary first embodiment of a security lock box 100 for use with a standard retail shelf 104 to both secure and at the same time display retail merchandise 103 supported on the shelf. The security lock box 100 includes a transparent top cover 110 that houses and thereby secures merchandise 103 when in use; and a security device 105 that releasable locks the top cover 110 to the shelf 104. An optional back cover 130 may be employed to cover a back opening if provided on the top cover 110. The security device 105 may take many forms but typically will include a shelf mount such as a locking bar 102 that can be securely fastened to the shelf 104 and a locking mechanism 112, which can selectively and releasably lock the top cover 110 to the locking bar 102. However, it is possible a locking mechanism 112 could directly lock the top cover 110 to the shelf 104 rather than through the locking bar 102 or other such shelf mount, and broader aspects of the claims are meant to encompass the same (e.g. the security device may be one or multiple components).

The locking mechanism 112 allows for selective access or securement of merchandise 103. As shown in FIG. 1, the top cover 110 is not yet secured to a locking bar 102, whereas in FIG. 2, the top cover 110 is secured to the shelf 104 over the merchandise 103. In this manner, a retailer can selectively elect to secure merchandise or allow access to merchandise via the security lock box 100. Further, as the top cover 110 is transparent, customers can readily view the merchandise 103 when it is secured; and even further, the standard shelving units employed at a retail outlet can be readily adapted and selectively adapted as desired by a retailer without having to purchase or make floor space for a new unit.

Turning in greater detail to the first embodiment, the locking bar 102 that is configured to be secured to a top flat surface 108 of the shelf 104, which, in an embodiment of the invention, is a standard shelf typically found in many retail establishments. In an embodiment of the invention, the shelf 104 has two rows of holes 106, though other embodiments may have a greater or lesser number of holes, evenly spaced along a front portion of the shelf 104. The holes 106 may be molded, drilled or punched through the shelf surface 108 near a front edge 109 of the shelf 104. It is through the holes 106 that the locking bar 102 is secured to the shelf 104. The locking bar 102 is typically aligned to run parallel to the front edge 109 of the shelf 104. A transparent top cover 110, which, in an embodiment of the invention, is made of clear plastic, can be placed over the locking bar 102 and slid towards the rear of the shelf 104 until a locking mechanism 112 is inserted through an opening 114 roughly in the center of the locking bar 102.

In other embodiments, the top cover 110 can be made from some other suitably strong, durable, and transparent material. By "transparent" top cover, it is meant that a sufficient portion of the top cover 110 is transparent so that customers will be able to readily view the merchandise 103 contained therein. Certain portions of the top cover 110, such as the top, back, and/or lower extremities may be opaque as such areas not critical to viewing of the merchandise 103 need not be transparent, but in such cases the top cover 110 is still considered a "transparent" top cover 110. Preferably, the entire top cover 110 is completely or fully transparent for manufacturing ease, necessitating only one material and maximizing viewing of secured merchandise 103.

In an embodiment of the invention, the locking mechanism 112 is inset through an opening 121 in a front panel 116 of the top cover 110. In one embodiment, the top cover 110 is substantially box-shaped having a front panel 116, a top panel 117, and two side panels 119. The top cover 110 may omit a bottom panel due to the presence of the locking bar 102, and so as to allow the top cover 110 to slide onto the shelf surface 108 without disturbing merchandise 103 on the shelf 104 to be secured by the security lock box 100. In some embodiments, a rear panel of the top cover 110 may be omitted when the top cover 110 will abut against a hard surface, such as a wall to which the shelf 104 is secured, or a vertical surface that is part of the structure of the shelf 104, which will prevent access to the interior of the top cover 110. A rear panel may also be omitted if the shelf is adequately deep or if it is desired to provide for substantial security or substantial deterrent, while at the same time allowing easy sliding capability of the top cover over merchandise stored on the shelf. It should be noted that the height, width, and depth of the top cover 110, along with the width of the locking bar 102, can be varied as needed to accommodate goods of various sizes.

In an embodiment of the invention, the opening 114 in the locking bar 102 is keyed to accept the locking mechanism 112 when the locking mechanism 112 is in the unlocked position. The locking mechanism 112 includes a barrel 127 with cylindrical cam 120 portion (shown in FIG. 1) at the rear of which is a vertical wall 118 (shown in FIG. 1), in which the barrel 127 is rotatable in a lock mount 119 which may be a tubular housing with screw threads and a bolt head to facilitate fastening into the opening 121 formed in the front panel 116. In one embodiment, the barrel 127, and cam 120 thereof, can be rotated relative to the lock mount 119 between locked and unlocked positions in which the cam engages or disengages the back side of the lock bar opening 114, respectively. The barrel 127 and cam 120 can be actuated by a key 123 that fits into a keyway 125 formed in front of the barrel 127. In one embodiment, the cam 120 is configured with a tapered edge. When the locking mechanism 112 is fully inserted into the opening 114 of locking bar 102, and the locking mechanism 112 is in the locked position, the vertical wall 118 at the rear of cam 120 interferes with the back side of the locking bar 102, thus preventing removal of the locking mechanism 112 from the locking bar 102, and preventing removal of the top cover 110 from the surface of the shelf 108. As a result, consumers and employees would have no access to merchandise 103 inside of the top cover 110. In this case, a key 123 would be required to unlock the locking mechanism 112 and remove the top cover 110 to gain access to any merchandise 103 inside the security lock box 100. However, in one embodiment of the invention, the cam 120 is spring-loaded, which causes the locking mechanism 112 to automatically lock (i.e., without using a key) when inserted into the locking bar opening 114.

Figure 2:
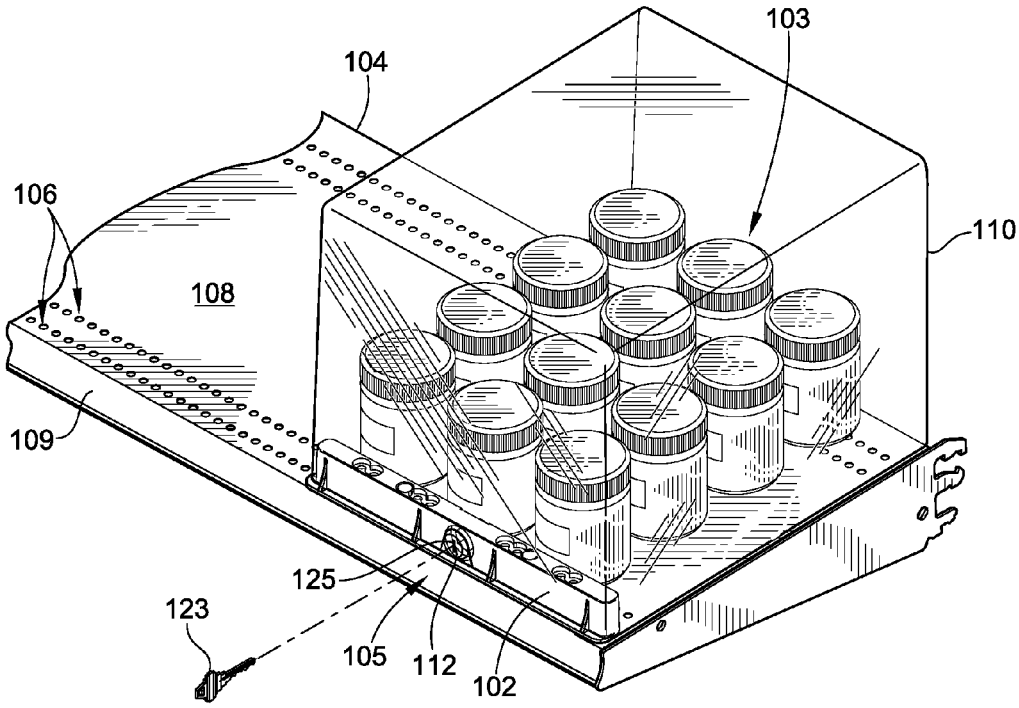
FIG. 2 is the security lock box of FIG. 1 with top cover secured to the locking bar.
Figure 3:
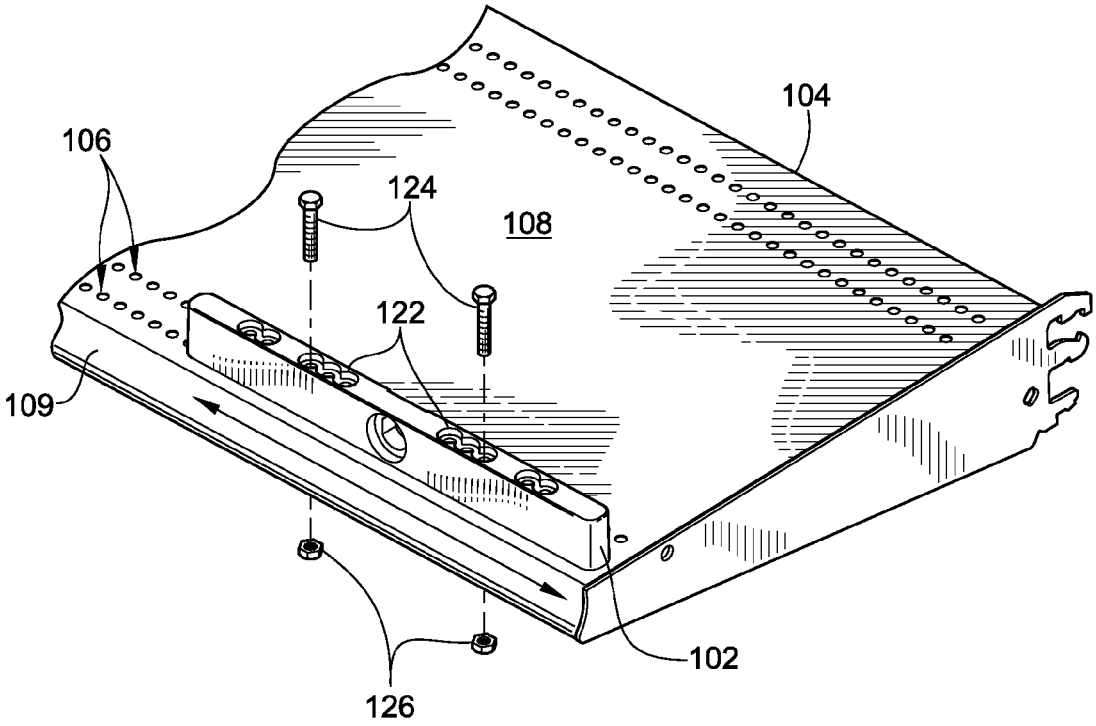
FIG. 3 is a perspective view illustrating the attachment of the locking bar to a shelf.

FIG. 3 is a perspective view illustrating how the locking bar 102 can be removably attached to the shelf 104 with suitable fasteners, such as nuts and bolts as illustrated, or other such fasteners including latches, clamps, push pins with snaps, cotter pins and the like. In an embodiment of the invention, the locking bar 102 has a plurality of holes 122 molded or machined vertically through the locking bar 102. Two or more of the plurality of holes 122 in the locking bar 102 are configured to align with two or more of the holes in either of the two rows of holes 106 near the front edge 109 of the shelf 104. When two or more of the plurality of holes 122 in the locking bar 102 are aligned with two or more of the holes 106 in the shelf 104, a pair of bolts 124 can be used to secure the locking bar 102 to the shelf 104 using nuts 126. In one embodiment, the locking bar 102 could be secured to holes in either row of the two rows of holes 106, such that the locking bar 102 is parallel to the front edge 109 of shelf 104. As can be seen from the embodiments of FIGS. 1 and 2, the width of the locking bar 102 may be approximately the same as the interior width of the top cover 110, leaving just enough room to slide the top cover 110 over the locking bar 102 towards the rear of the shelf 104. In this way, the locking bar 102 helps position the top cover 110 as it is secured over any merchandise to be protected under the security lock box 100, and also helps align the locking mechanism 112 with the locking bar opening 114. However, as will be seen, the width of the locking bar can be substantially smaller than the width of the top cover.

Figure 4:
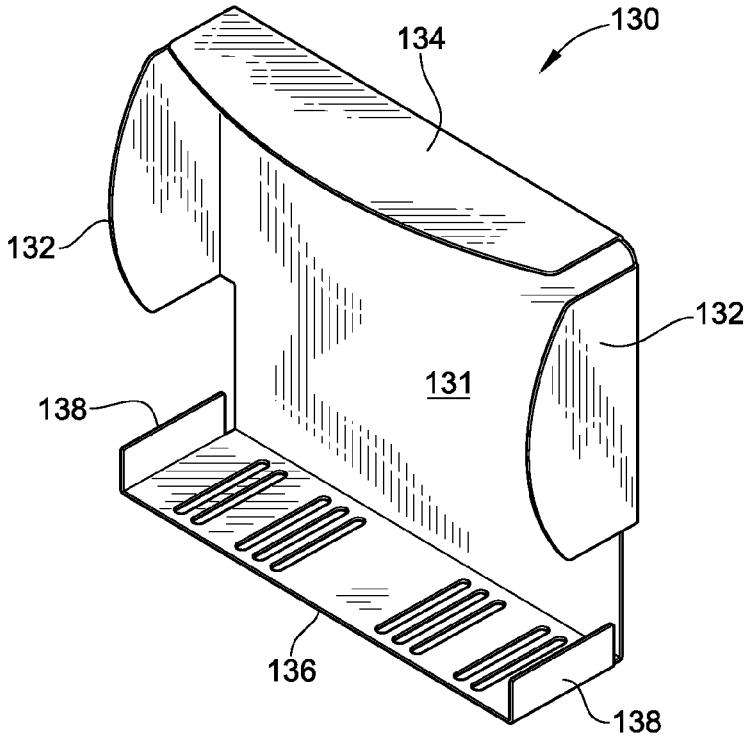
FIG. 4 is a perspective view of a back plate cover, according to an embodiment of the invention.

As mentioned above, embodiments of the top cover 110 may not have a rear panel when the top cover 110 is expected to abut a wall or solid vertical portion of the shelf 104 structure, such that the wall or vertical portion prevents access into the security lock box 100 from the rear. However, when no wall or vertical portion of the shelf 104 is present, a back plate cover 130, as illustrated in FIG. 4, may be used. In an embodiment, the back plate cover 130 includes a solid back panel 131, and also has two side flaps, or ears, 132, a top flap 134, and a flat mounting area 136 with two upturned edges 138 on each side of the flat mounting area 136. The back plate cover may be formed from sheet metal, such as steel or aluminum, or may be made from other suitably strong and durable material, including, but not limited to, certain types of plastics. In one embodiment, the top flap 134 is configured to be slightly higher than the height of the top cover 110, while the distance between the two side flaps 132 is configured to be slightly wider than the interior width of the top cover 110. The distance between the two upturned edges 138 is configured to be slightly narrower than the interior width of the top cover 110.

Figure 5:
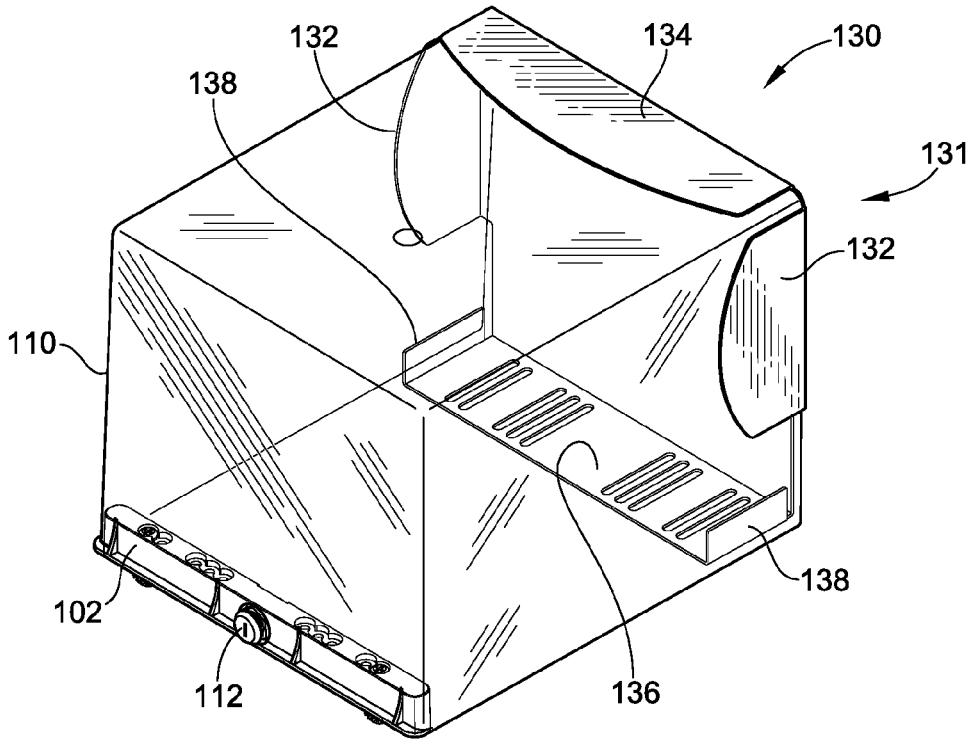
FIG. 5 is a perspective view of the back plate cover of FIG. 4 assembled to the security lock box top cover.

FIG. 5 is a perspective view illustrating how the back plate cover 130 assembles to the top cover 110, according to an embodiment of the invention. As can be seen, the two side flaps 132 and the top flap 134 are aligned just outside of three panels of the top cover 110, and are configured to prevent both the lifting of the top cover 110 and the pulling outward of the side panels 119 of the top cover 110. In an embodiment of the invention, the two upturned edges 138 on each side of the flat mount area 136 are aligned at an approximately 90-degree angle to the flat mount area 136, and are configured to prevent the side panels 119 of the top cover 110 from being pushed inward. The back panel 131 is substantially flush against the rear edges of the top cover 110 and prevents anyone from gaining access to the interior of the security lock box 100 from the rear without breaking one or more components of the security lock box 100.

Figure 6:
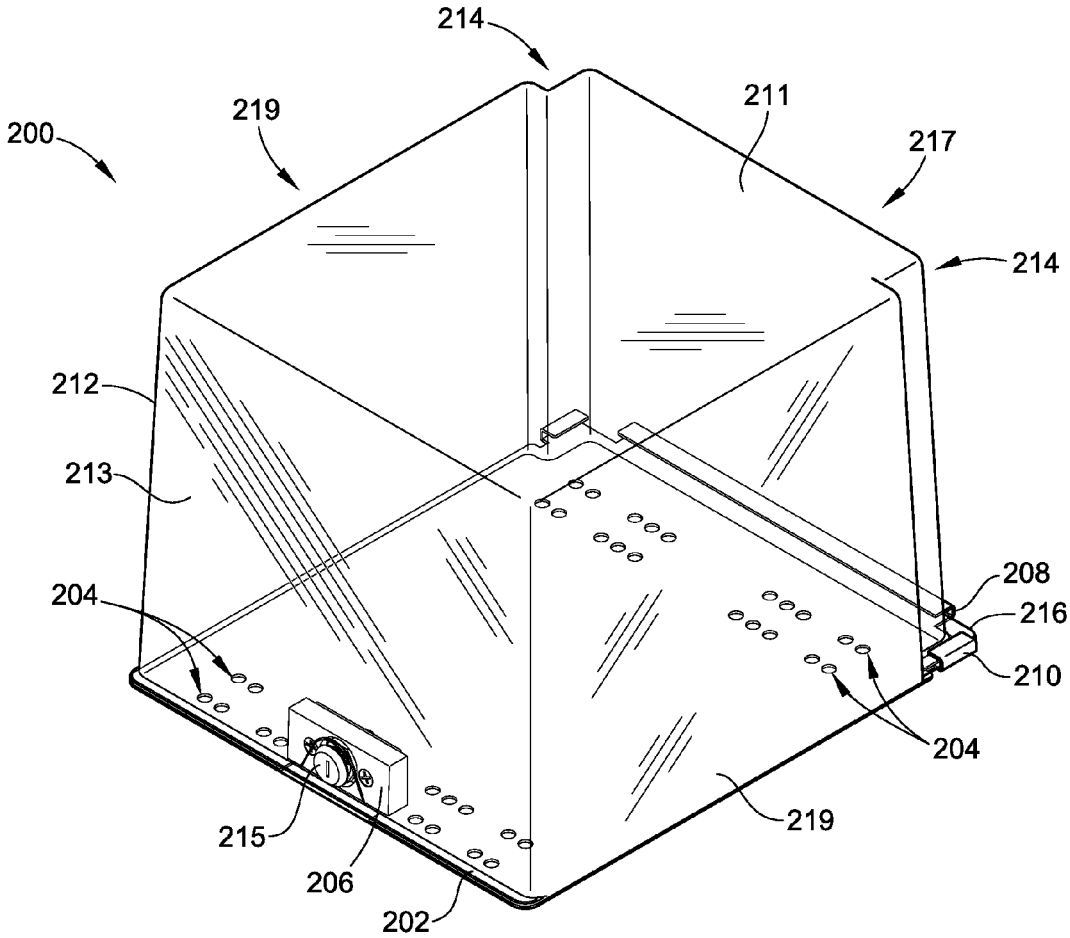
FIG. 6 is a perspective view of the security lock box with a bottom plate, according to an embodiment of the invention.

There may be instances when it is advantageous to have a security lock box, but where the user does not have a standard retail shelving system, for example one which does not have a plurality of holes for mounting the locking bar, such as described above. FIG. 6 is a perspective view of an embodiment of a security lock box 200 which includes a false floor or shelf surface covering in the form of a base plate 202 for mounting to a flat surface other than the standard retail shelf shown in FIGS. 1 and 2. The base plate 202 has a plurality of holes 204, which can be used to removably attach the base plate 202 to the flat surface, for example using nuts and bolts (not shown) in a fashion similar to that shown in FIG. 3 for securing the locking bar 102 to the shelf 104. In one embodiment, the base plate 202 includes a first C-shaped channel 208 that runs along a substantial portion of the rear edge of the base plate 202, and two shorter C-shaped channels 210 on each side and towards the rear of the base plate 202 near the first C-shaped channel 208.

Figure 7:
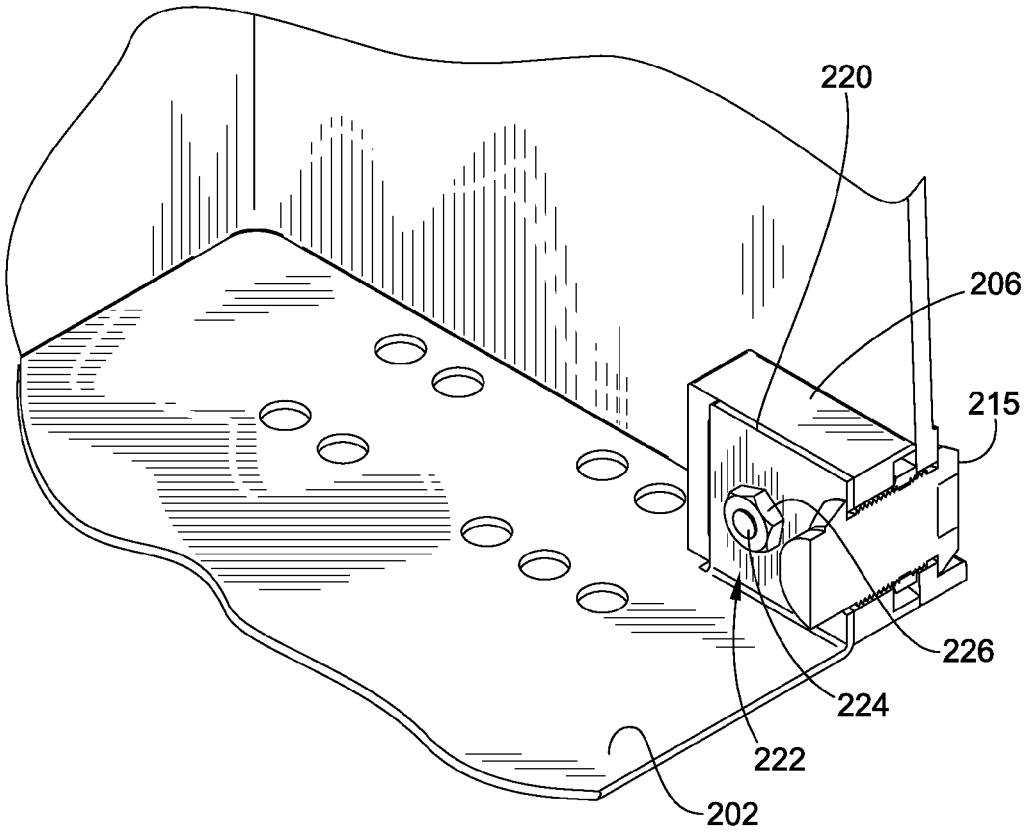
FIG. 7 is a cross-sectional view of the locking bar and locking mechanism shown in FIG. 6.

The plurality of holes 204 in the base plate 202 can also be used to removably attach a locking bar 206 through the base plate 202 to the flat surface. FIG. 7 shows a cross-sectional view of the locking bar 206 and of a locking mechanism 215 configured to be used in the locking bar 206. In this embodiment, two portions of the base plate 202 are bent into a vertical position. The two vertical portions 220 abut the locking bar 206 and straddle the locking mechanism 215. On each side of the locking mechanism 215, a bolt hole 222 in the vertical portion 220 aligns with a bolt hole in the locking bar 206. Two bolts 224 and two nuts 226 secure the locking bar 206 to the vertical portions 220, and, thus, to the base plate 202.

Referring again to FIG. 6, the security lock box 200 also has a transparent top cover 212, which may be made from clear hard plastic or some similar type of material. The top cover 212 is essentially box-shaped having a top panel 211, a front panel, 213, a rear panel 217, and two side panels 219. However, in the embodiment shown in FIG. 6, the top cover 212 includes two vertical notched areas 214 at the rear corners of the top cover 212, and the locking mechanism 215 located in the front panel 213. The locking mechanism is configured to be inserted into an opening (not shown) in the locking bar 206. In an embodiment of the invention, the opening is keyed to accept the locking mechanism 215 when the locking mechanism 215 is in the unlocked position. In one embodiment, the opening is located roughly in the center of the locking bar 206. As in the previous embodiment, the height, width, and depth of the top cover 212 may be varied as needed to accommodate a wide variety of goods.

The notched areas 214 are configured to facilitate the mating of the top cover 212 to the base plate 202, while permitting the non-notched portion of the top cover 212 to be wider than the notched portion at the rear of the top cover 212. Further, along the entire length of the bottom rear edge of the top cover 212 there is a horizontal flange 216. The flange 216 extends a relatively short distance around both sides such that the flange 216 runs along the bottom side edges toward the rear of the top cover 212 having a length, along the sides, that corresponds to the depth of the notched areas 214. The C-shaped channels 208, 210 are all configured to receive the flange 216 when the locking mechanism 215 of the top cover 212 is fully inserted into an opening in the locking bar 206, thus preventing the top cover 212 from being lifted off of the flat surface. The dimensions of the shorter C-shaped channels 210 determine how wide and how deep the flange 216, and, therefore, the notched areas 214 need to be.

In an embodiment of the invention, the locking mechanism 215 is similar to locking mechanism 112 shown in FIGS. 1 and 2, in that locking mechanism 215 has a cylindrical body (not shown), with an opening for a key at a front end of the cylindrical body and a vertical wall (not shown) at a rear end of the cylindrical body, and a spring-loaded cam mechanism. Accordingly, the top cover 212 can be placed towards the front of the base plate 202 and slid toward the rear until the flange 216 is inserted into the C-shaped channels 208, 210, and until the locking mechanism 215 is fully inserted into the opening (not shown) in the locking bar 206. In embodiments where the locking mechanism 215 includes the spring-loaded cam mechanism, which in at least one embodiment has a tapered edge, the locking mechanism 215 will lock automatically (i.e., without a key) once inserted into the locking bar 206. However, a key (not shown) would be needed to unlock the locking mechanism 215 to allow removal of the top cover 212 from the base plate 202, thus providing access to the merchandise 103 inside the security lock box 200.

As can be seen from the embodiment of FIG. 6, the width of the locking bar 206 can be substantially narrower than the interior width of the top cover 212. In this embodiment, the locking bar 206 will be lighter and may be less expensive than the wider locking bar 102 of FIGS. 1 and 2. Additionally, because the C-shaped channels 208, 210 serve to position top cover 212 on the base plate 202, in some embodiments, the wider locking bar 102, which helps position the top cover 110 (in FIGS. 1 and 2), is not necessarily as helpful in the embodiment of FIG. 6.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A security lock box for protecting merchandise against theft comprising:

a locking bar having an opening therethrough, and configured to be removably attached to a flat surface; and a transparent top cover having a locking mechanism, the top cover configured to securely enclose merchandise placed on the flat surface;

wherein the locking mechanism is configured to be inserted into the locking bar opening such that the top cover is securely attached to the flat surface so as to prevent access to merchandise enclosed by the top cover;

wherein the locking bar is configured to accept top covers of various sizes; and wherein the entire locking bar is configured to be enclosed within the top cover when the top cover is secured to the locking bar via the locking mechanism.

2. The security lock box of claim 1, wherein the locking bar is a substantially rectangular rail that abuts a front panel of the top cover when the top cover is secured to the locking bar via the locking mechanism.

3. A security lock box mountable to a shelf having a shelf surface for supporting merchandise thereon, the security lock box comprising:

a cover adapted to be supported on top of the shelf and adapted to house and secure merchandise supported on the shelf therein, the cover being at least partially transparent to display merchandise when housed therein; and a security device including a shelf mount and a lock, the shelf mount adapted to be fastened to the shelf and the lock releasably locking the cover to the shelf mount between a locked state wherein the cover is locked to the shelf mount and unlocked state wherein the cover is releasable from the shelf mount;

wherein the shelf mount its completely within the cover when the security lock box is in the locked state, and wherein the shelf mount is configured to work with covers of various sizes.

4. The security lock box of claim 3, wherein the shelf mount is a substantially rectangular rail that abuts a front panel of the cover when the cover is secured to the shelf mount via the lock.

5. A security lock box for protecting merchandise against theft comprising:

a locking bar having an opening therethrough, and configured to be removably attached to a flat surface; and a transparent top cover having a locking mechanism, the top cover configured securely enclose merchandise placed on the flat surface;

wherein the locking mechanism is configured to be inserted into the locking bar opening such that the top cover is securely attached to the flat surface so as to prevent access to merchandise enclosed by the top cover;

wherein the top cover is open along a bottom portion and along a back portion, the bottom portion configured to abut the flat surface and the back portion configured to abut a vertical surface attached to the flat surface.

6. A security lock box mountable to a shelf having a shelf surface for supporting merchandise thereon, the security lock box comprising:

a cover adapted to be supported on top of the shelf and adapted to house and secure merchandise supported on the shelf therein, the cover being at least partially transparent to display merchandise when housed therein; and a security device including a shelf mount and a lock, the shelf mount adapted to be fastened to the shelf and the lock releasably locking the cover to the shelf mount between a locked state wherein the cover is locked to the shelf mount and unlocked state wherein the cover is releasable from the shelf mount;

wherein the cover is open along a bottom portion and along a back portion, the bottom portion configured to abut the shelf and the back portion configured to abut a vertical surface attached to the shelf.

7. An apparatus for displaying and securing merchandise, comprising, in combination:

a merchandise shelf adapted to support said merchandise thereon;

a cover supported on top of the shelf and adapted to house and secure merchandise supported on the shelf therein, the cover being at least partially transparent to display, merchandise when housed therein; and a security device securing the cover to the shelf in a locked state; the security device releasing the cover to allow access to merchandise in an unlocked state;

wherein the security device is a substantially rectangular rail that abuts a front panel of the cover when the cover is secured to the security device via a locking device, and wherein the security device fits completely within the cover when the apparatus is in the locked state, and wherein the security device is configured to work with covers of various sizes.

* * * * *

UNITED STATES PATENT AND TRADEMARK OFFICE

CERTIFICATE OF CORRECTION

PATENT NO. : 8,286,565 B2
APPLICATION NO. : 12/619762
DATED : October 16, 2012
INVENTOR(S) : Thomas E. Valiulis et al.

It is certified that error appears in the above-identified patent and that said Letters Patent is hereby corrected as shown below:

Claim 3, Col. 8,
Line 1, change “its” to “fits”

Claim 5, Col. 8,
Line 14, insert a --,-- after “configured”

Claim 7, Col. 8,
Line 48, remove the “,” after “display”

Signed and Sealed this
Fourth Day of December, 2012

David J. Kappos

David J. Kappos
*Director of the United States Patent and Trademark Office*